United States Patent [19]

Rosado et al.

[11] Patent Number: 4,838,027

[45] Date of Patent: Jun. 13, 1989

[54] POWER CYCLE HAVING A WORKING FLUID COMPRISING A MIXTURE OF SUBSTANCES

[75] Inventors: Serafin M. Rosado; Luiz E. D. Vallejo, both of Madrid, Spain

[73] Assignee: Carnot, S.A., Spain

[21] Appl. No.: 175,906

[22] Filed: Mar. 31, 1988

[30] Foreign Application Priority Data

Apr. 8, 1987 [ES] Spain ..... 8701019

[51] Int. Cl.[4] ..... F01K 25/00

[52] U.S. Cl. ..... 60/671; 60/651; 60/649

[58] Field of Search ..... 60/651, 671, 649

[56] References Cited

U.S. PATENT DOCUMENTS 4,232,525 11/1980 Enjo et al. ..... 60/671

4,439,988 4/1984 Minardi et al. ..... 60/649

*Primary Examiner*—Allen M. Ostrager

*Attorney, Agent, or Firm*—Ostrolenk, Faber, Gerb & Soffen

[57] ABSTRACT

A power cycle operating with a maximum temperature above 300° C. The power cycle operates with a working fluid comprising a mixture of water and another substance having lower volatility, greater molecular weight and tendency to superheat in isentropic expansion. Both substances are vaporized in a boiler, in part at variable temperature, and expanded in at least one turbomachine. After the first expansion, heat is yielded at constant pressure, wherein part of the least volatile substance condenses at variable temperature. In comparison with a steam cycle, this new cycle offers higher efficiences because it has the advantage of increasing the average temperature of heat absorption, without intermediate reheating and without condensation occurring in the turbine until very low exhaust pressures are reached, depending on the proportion of the mixture used. A secondary cycle of refrigerant fluid may be utilized with the power cycle of the present invention.

22 Claims, 4 Drawing Sheets

A
T-I
T-II
RS
RC
DAC
B-I
B-II
B-III
C
D
FURNACE
EAC
EAC
VAC
VAG
1
2
3
4
5
6
7
8
9
10
11
12
13
14
15
16
17
18
19
20
21
22
23
24
25

POWER CYCLE HAVING A WORKING FLUID COMPRISING A MIXTURE OF SUBSTANCES

BACKGROUND OF THE INVENTION

1. Field of the Invention

The invention relates to a thermodynamic power cycle.

2. Description of the Related Art

In order to achieve high thermal efficiencies, conventional steam cycles require high operating pressures in addition to preheating of feed water before it begins absorbing heat from a heat source. With high operating pressures and preheating, one can obtain a high average temperature of heat absorption. However, both techniques have limitations which make it difficult to obtain high efficiencies.

Increasing pressure is limited by the maximum working temperature of the working fluid. If the working temperature is not high enough for a given pressure, water will condense in the turbine, reducing the isentropic efficiency thereof and increasing blade deterioration and maintenance cost. At a given maximum working temperature, which may be limited by, for example, corrosion problems, the heat source, economic reasons, etc., the only way to raise the pressure beyond the corresponding limit is by reheating the steam at an intermediate pressure. This process is costly and usually is not feasible in medium-size plants. Also, any pressure increase results in a corresponding decrease in the global efficiency of the turbine, partly due to the low specific volume of the steam.

The regenerative preheating of the feed water is disadvantageous because it must be accomplished by steam extractions from the turbine and thus its effectiveness is proportional to the number of these extractions. In smaller size plants, the number of steam extractions from the turbine is limited. Because of this limitation, as well as the complexity and cost of the cycle as a whole, cycle efficiency is reduced.

On the other hand, when one tries to utilize a secondary cycle of ammonia, the steam discharged by the steam cycle is wet or very close to saturation and, therefore, the ammonia can not be superheated unless steam is extracted from the turbine. This involves a great irreversibility and efficiency loss. The alternative of expanding the ammonia from the saturation line also diminishes the efficiency of the ammonia turbine and increases the maintenance cost.

SUMMARY OF THE INVENTION

Accordingly, it is an object of the invention to provide a power cycle which achieves high thermal efficiencies without high operating pressures.

It is another object of the invention to provide a power cycle which achieves high thermal efficiencies without preheating feed water.

These and other objectives are achieved by providing a power cycle having a working fluid which comprises a mixture of water and another much less volatile substance having a much higher molecular weight and a tendency to superheat in isentropic expansion. The two substances are vaporized, partly at variable temperature, absorbing energy from an external heat source. The vapor is expanded in a turbine, and an internal heat recovery is performed while a main vapor flow yields heat at variable temperature. The vapor then completely condenses.

DETAILED DESCRIPTION OF THE PREFERRED EMBODIMENTS

Figure 1:
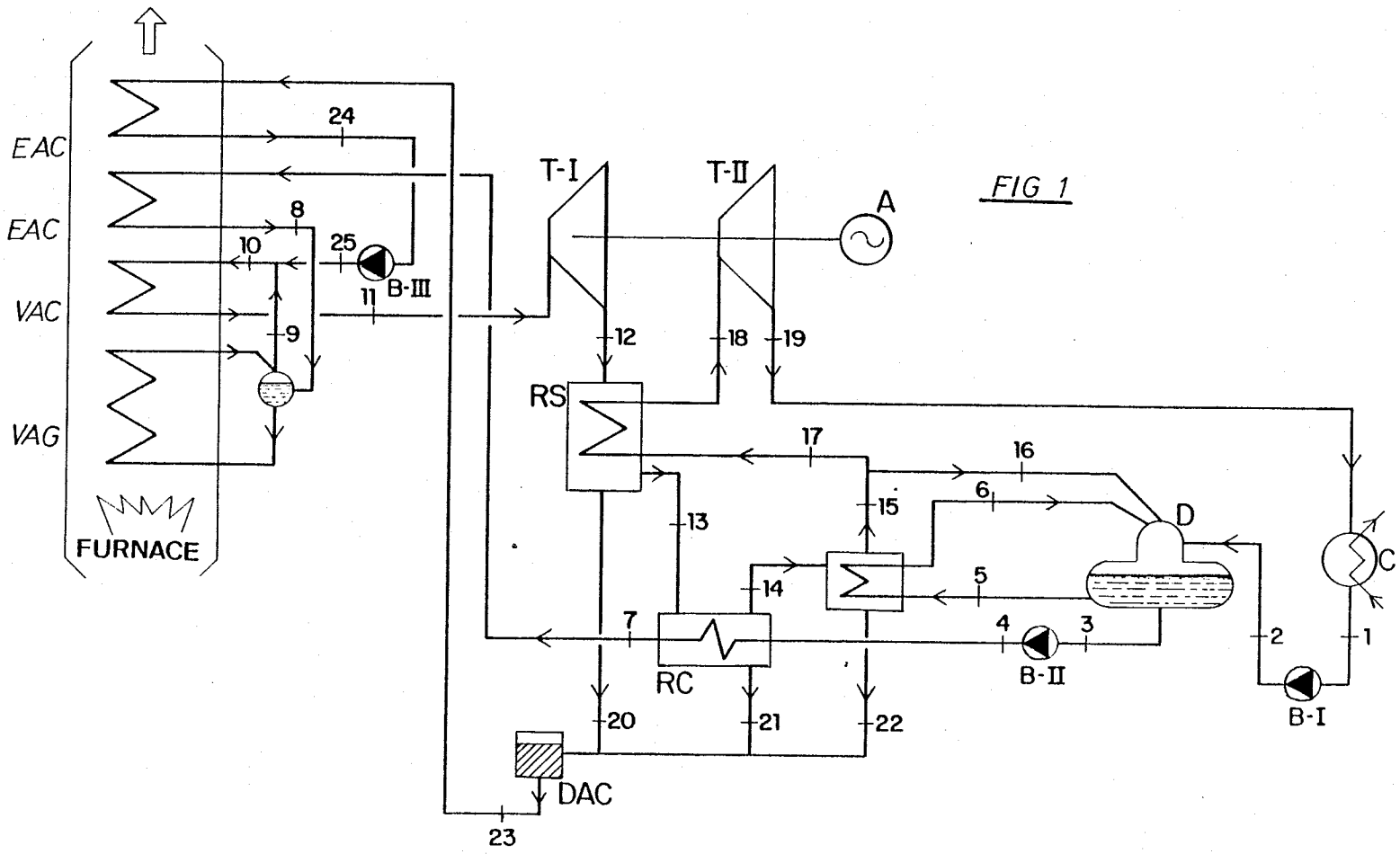
FIG. 1 illustrates a power cycle according to the invention.

The invention uses a working fluid comprising a mixture of water and another less volatile second substance, having a higher molecular weight and a tendency to superheat in isentropic expansion in such a way that one can obtain dry or substantially dry expansions at pressures down to exhaust pressures. Steam at the same pressure and temperature conditions does not achieve dry expansions.

In a basic scheme of the invention, the two substances are vaporized in a boiler at the maximum working pressure, partly at variable temperature, and are expanded in a turbine. At the minimum working pressure, or at an intermediate point of the expansion, a heat yield is performed at constant pressure to preheat the boiler feed. Part of the less volatile substance is condensed and separated from the remaining vapor. This vapor goes directly to the condenser (if it is at the minimum working pressure), or is otherwise expanded to the minimum working pressure. At the minimum working pressure, the vapor condenses completely. The liquids are pumped up to the maximum working pressure and heated by the aforementioned heat. The liquids are then fed to the boiler to complete the cycle.

The two substances used may be vaporized together in the boiler of the installation (if a one-through type construction without a drum). Alternatively the water may be vaporized first in a conventional system with drum and water recirculation and then the other substance (in liquid state) may be mixed with the steam and the mixture then totally vaporized.

To carry out this latter method, it is necessary that both substances can be recovered separately in liquid phases to a certain purity. Specifically, the water must not bear a greater proportion of the other substance than that of the eutectic mixture of vapors at drum pressure, because otherwise the excess of the other substance would accumulate in the drum. The separation can be done: during non-eutectic condensation of the least volatile substance at variable temperature at various points of the cycle; by separating the working fluid as a liquid state if the water and the other substance are immiscible; by separating the part of the least volatile substance which has condensed during one of the mixture expansions; or, by cooling with water.

Once the mixture is expanded in a turbine (during which heat may be removed) from the maximum cycle pressure to a lower pressure, a mixture results at higher temperature than that of saturation of water. Under these conditions, it is necessary for the mixture to yield heat so that the least volatile substance can condense at variable temperature. If the turbine exhaust is totally dry, it is necessary first to cool it down to the dew point of the least volatile substance before condensation of this substance. If the exhaust is wet with the least volatile substance, the two phase mixture may proceed to yield heat directly, condensing an additional fraction of the least volatile substance. The condensed part may be separated first to then yield heat and condense additional fractions. This heat yield is usually done in a heat exchanger (with separation of the least volatile substance at its bottom) which condenses the less volatile substance at variable temperature so as to maintain its heat content. Depending on the design of the heat exchanger, there is also the possibility that the condensed fraction, together with the remaining vapor, continues cooling down. In some cases, it may also be preferred to cool the mixture discharged from the turbine by injecting liquid water, which vaporizes while condensing the least volatile substance.

When the final pressure of the in-turbine expansion coincides with that of saturation of the water at a practical temperature for yielding heat to the sink, the heat yielded by the mixture at the turbine outlet will be used in part for heating the final condensate of the cycle. The heat may also be used for heating the condensed part of the least volatile substance separately if it is not mixed with the final condensate. The heat may also be used in various heating processes, e.g., to superheat water, steam or thermal fluid, or heat combustion air.

The pressure at the turbine outlet will be higher than that of saturation of water and, therefore, it will be necessary to carry out one or more additional expansions in order to complete the cycle, or to use the excess energy for a secondary cycle or a heating process. It is also possible to carry out another expansion and still have excess energy for heating process or even for secondary cycles if the outlet pressure of this expansion is still not too low.

In the case where one or more additional expansions are necessary, in order to achieve a low pressure so that all the heat yielded by the cycle during the condensation of water will go to the sink, it will be necessary that the final temperature before starting to yield heat to the sink is sufficiently low. This is achieved through heat yields of the vapor mixture (for heating condensates or combustion air) and through in-turbine expansion, condensing part of the least volatile substance. Wet, in-turbine expansions is preferred when using radial flow expanders. In any case, but especially when using air turbines, it is preferred that expansions be as dry as possible. For this purpose, the vapor mixture can be cooled to about the dew point of the water by heating condensates or vaporizing water in a superficial or mixing heat exchanger. This will reduce to a minimum the proportion of the least volatile substance in the vapor. One can also superheat the vapor mixture, thereby recovering heat from the vapor mixture at a higher thermal level with more of the least volatile substance.

If the vapor mixture (after one or two expansions) is at a sufficiently high pressure as to have an appreciable thermal level during the condensation at constant temperature of the water, it will be necessary to use the heat yielded during condensation at constant temperature of the water (which is always accompanied by the eutectic proportion of the other substance) as well as heat from the last fraction of the condensation at variable temperatures of the other substance. This heat can be used for heating processes (through hot water, steam, etc.) or to serve as an external energy source for another power cycle with a fluid of low boiling point (ammonia, freon, etc.). Given that a part of this heat yield takes place at variable temperature and at a higher thermal level than that of the main yield corresponding to the eutectic condensation, it is possible to superheat the fluid used in the secondary cycle. This is preferred in order to preheat the condensate of the secondary cycle by the superheated exhaust of the turbine of the power cycle or in order to obtain a virtually dry exhaust from the turbine with fluids of wet isentropic expansion such as ammonia. Likewise, a part of the heat yielded at variable temperature can be used for heating combustion air when using an external energy sourced that utilizes fuels such as fossil, residual, or biomass fuels, etc.

According to the invention several advantage result. In applications with a limited maximum temperature due to problems of corrosion in the superheater (refuse power plants) or to limitations of the energy source (thermosolar, nuclear, geothermal power plants, etc.), higher working pressure and/or dry expansions can be achieved, with a concomitant increase in efficiency.

In applications with an unlimited temperature except for limitations of materials (usually about 550° C.), higher pressures and lower humidity in the turbine and/or eliminating the intermediate reheating of the vapor is possible with the accompanying advantages in cost and efficiency. This can be especially advantageous in medium power thermal plants (usually about 100 MWe), or in ship propulsion power plants.

The greater molecular weight of the vapor mixture and the diminution in the specific enthalpic drop will allow a reduction in the number of turbine stages and/or an increase in its efficiency, especially in the high pressure zone.

At the same pressure in the boiler and the same maximum temperature, an increase in the average temperature of heat absorption and the elimination or reduction of the superheater can be achieved. Vaporization under these conditions improves the average absorption temperature, resulting in a better heat transmission rate and higher average specific heat than in the case of superheating steam.

Preheating the condensate with the heat yielded at variable temperature by the main vapor flow reduces the irreversibility of the heating and eliminates or reduces the number of turbine extractions. The extractions can then be accomplished at lower pressure than in a steam cycle for the same temperature of condensate heating.

The ability to vaporize a secondary cycle fluid using the substantially isothermal condensation of the final eutectic is achieved. Also, one can superheat the vapor of the fluid up to considerable temperatures using a part of the heat yielded during condensation at variable temperature of the least volatile substance of the main flow down to the saturating temperature of an aforementioned eutectic.

In the secondary cycle, condensate can be heated with the superheated vapor exhausted by the turbine, thereby increasing the efficiency of this cycle and, therefore, of the whole system. Also a dry expansion of this fluid in the turbine (when using a fluid with wet isentropic expansion) increases thereby the efficiency of this expansion and, therefore, that of the whole system and the service life of the turbine.

The less volatile substance may be a commercial thermal oil. Preferably, the oil is selected from the following: Santotherm VP-1, Dowtherm-A, Dyphil and Termex. The oil may be a eutectic mixture (minimum freezing point of the mixture) of diphenyl and diphenyl oxide. Thermodynamically, it behaves in a very similar manner to the individual behavior of each substance, since their saturation curves are very close. Its advantage over the the two individual substances is that it has a lower freezing point. In the following examples, it is called "oil."

Referring now to FIG. 1, the power cycle of this invention is illustrated. The cycle utilizes a mixture of water and the aformentioned oil, absorbing energy in a refuse incineration boiler cooling gases from 900° C. to 250° C. This is the temperature at which the gases are used for preheating the combustion air. This preheating may also be accomplished by absorbing the heat from the gases with an intermediate fluid which can act as heat regulator and storage. The intermediate fluid may be the oil of the cycle. The energy absorbed by the cycle is used for generating electric power through two turbines and the residual heat is sent directly to the heat sink which may be cooling water at about 25° C.

Figure 2:
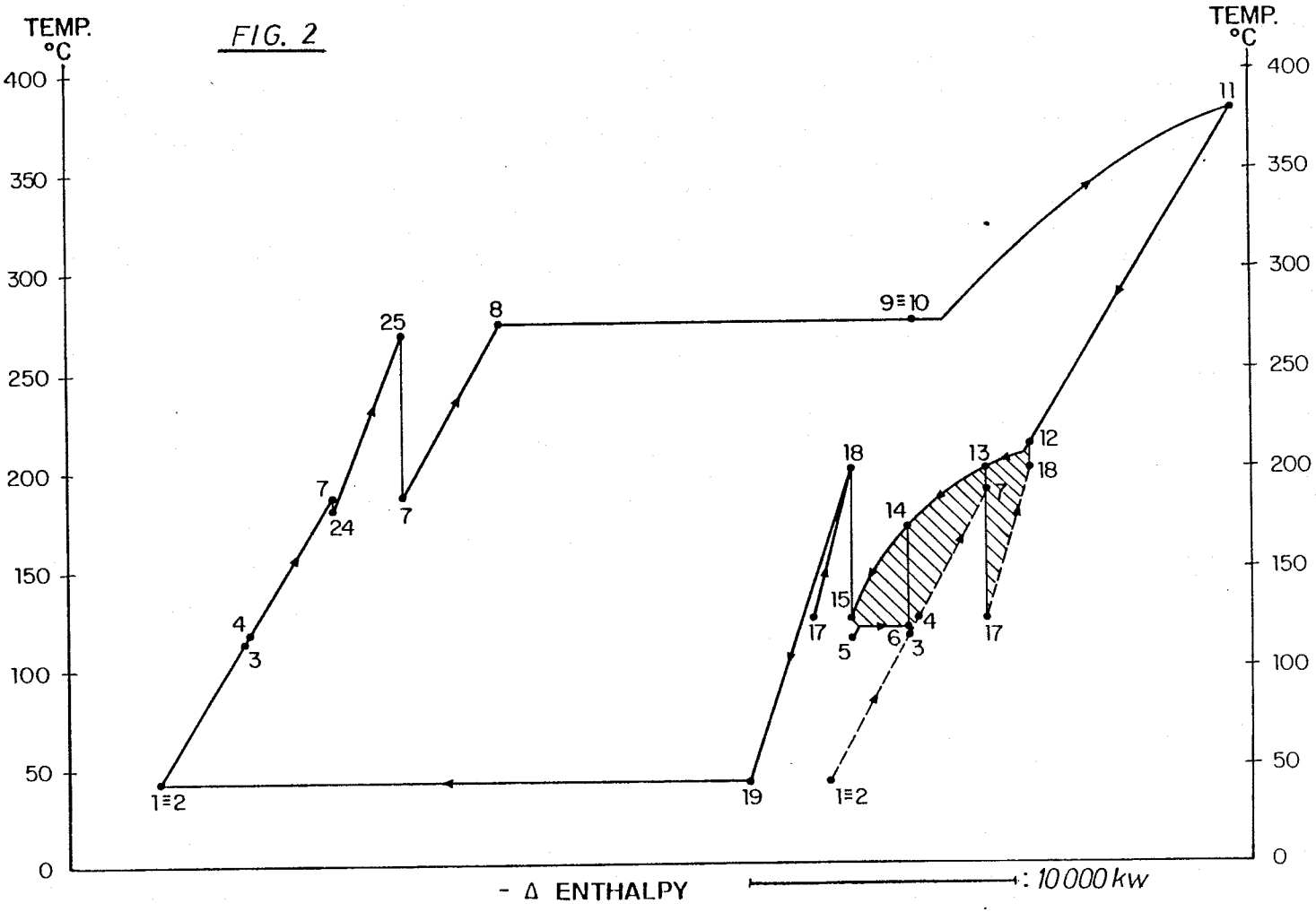
FIG. 2 illustrates a plot of t-ΔH for the power cycle of FIG. 1.

FIG. 1 shows the main diagram of the cycle. The abbreviations used in the figure are:

EAC=Oil economizer
EAG=Water economizer
VAC=Oil vaporizer
VAG=Water vaporizer
T=Turbine
B=Pump
A=Alternator
D=Deaerator
C=Condenser
RS=Recuperator-superheater
RC=Recuperator-heater
AM=Mixture desuperheater
SF=Phase separator
DAC=Oil tank FIG. 2 shows a t-Δh diagram of the cycle, wherein the thermal levels and the relative magnitudes of enthalpy yields and absorptions of the heat exchanges and in-turbine expansions can be observed.

Table 1 below shows, for each point of the cycle, the circulating flow and its phase (liquid or vapor), as well as the pressure, temperature and enthalpic flow. This thermal balance does not take into account pressure drop, fluid leak, thermal loss, or the heat yielded to the fluid by the pumps, but does consider the isentropic efficiencies in the turbines and the practical minimum temperature difference in heat exchangers. The enthalpic values have been calculated by algorithms.

TABLE 1

| CYCLE POINT | WATER FLOW (kg/s) PHASE (L/V) | OIL FLOW (kg/s) PHASE (L/V) | ENTHALPIC FLOW (kW) | PRESSURE (bar abs) | TEMPERATURE (°C.) |
|---|---|---|---|---|---|
| 1 | 9.16/L | 0.57/L | 690 | 0.08 | 42 |
| 2 | 9.16/L | 0.57/L | 690 | 2 | 42 |
| 3 | 9.44/L | 0.66/L | 3739 | 2 | 115 |
| 4 | 9.44/L | 0.66/L | 3739 | 60 | 115 |
| 5 | 1.03/L | 0.06/L | 400 | 2 | 115 |
| 6 | 1.03/V | 0.06/V | 2712 | 2 | 120 |
| 7 | 9.44/L | 0.66/L | 6856 | 60 | 190 |
| 8 | 9.44/L | 0.66/L | 10940 | 60 | 275 |
| 9 | 9.44/V | 0.66/V | 25733 | 60 | 276 |
| 10 | 9.44/V & L | 14.16/L & V | 32030 | 60 | 275 |
| 11 | 9.44/V | 14.16/V | 42854 | 60 | 380 |
| 12 | 9.44/V | 14.16/V | 35578 | 2 | 214 |
| 13 | 9.44/V | 11.52/V | 33267 | 2 | 199 |
| 14 | 9.44/V | 4.34/V | 27976 | 2 | 170 |
| 15 | 9.44/V | 0.66/V | 24837 | 2 | 125 |
| 16 | 0.28/V | 0.09/V | 737 | 2 | 125 |
| 17 | 9.16/V | 0.57/V | 24100 | 2 | 125 |
| 18 | 9.16/V | 0.57/V | 25583 | 2 | 200 |
| 19 | 9.16/V & L | 0.57/L & V | 21763 | 0.08 | 42 |
| 20 | 0 | 2.64/L | 828 | 2 | 203 |
| 21 | 0 | 7.18/L | 2174 | 2 | 189 |
| 22 | 0 | 3.68/L | 827 | 2 | 153 |
| 23 | 0 | 13.50/L | 3829 | 2 | 182 |
| 24 | 0 | 13.50/L | 6297 | 2 | 270 |
| 25 | 0 | 13.50/L | 6297 | 60 | 270 |

Enthalpy reference points:
Water: 0 kJ/kg liquid at 25° C.
Oil: 0 kJ/kg liquid at 25° C.

Starting at the right side of FIG. 1, a liquid mixture of mostly water and a small amount of oil (point 1) is recovered from condenser C. The liquid mixture is pumped (point 2) via pump B-I to deaerator D. Liquid water and a small amount of liquid oil collects in the deaerator D and flows to pump B-II (point 3) and is then pumped (point 4) to the recuperator/heater heat exchanger RC. The liquid water and oil absorbs heat in heat exchanger RC.

The heated, liquid water and oil is then introduced. (point 7) into a furnace where it is heated further (point 8). Heated, liquid water and oil flows to a tank, where it is collected, and then back to the furnace where the liquid water together with the oil is vaporized (point 9). The vaporized water and oil is mixed with additional oil to form a mixture of water and oil wherein both components are present in the liquid and vapor phases (point 10). This mixture is then vaporized in the furnace to produce a totally vaporous flow of the water and oil (point 11).

This vapor flow is expanded (point 12) in turbine T-I with the expanded flow then flowing to recuperator/-superheater heat exchanger RS. In heat exchanger RS, the expand vapor is cooled, and condensed liquid oil is collected from heat exchanger RS (point 20). Collected oil accumulates in oil tank DAC and is then returned to the furnace (point 23) to be heated (point 24) and mixed via pump B-III (point 25) with the vaporized water and oil, as discussed above.

Cooled liquid and oil vapor (point 13) exits heat exchanger RS and enters recuperator/hater heat exchanger RC. Again, condensed liquid oil is collected in heat exchanger RC (point 21) and accumulated in oil tank DAC, as discussed above. Water and oil vapor passes through heat exchanger RC in countercurrent flow with the mostly liquid water (and small amount of liquid oil) flowing between the aearator D and furnace. Heat is absorbed by the mostly liquid flow.

A stream of cooled water and oil vapor exits heat exchanger RC (point 14) and flows to a third heat exchanger. In the third heat exchanger the cooled water and oil vapor from heat exchanger RC flows in countercurrent to a liquid stream taken from the deaearator D (point 5). The liquid stream from deaerator D is heated in the third heat exchanger to a vapor (point 6) and the vapor (containing mostly water) is returned to deaearator D.

The cooled water and oil vapor exiting the third heat exchanger (point 15) contains mostly water vapor. A small amount of the water and oil vapor is flowed to the deaerator D (point 16). The majority of the flow stream exiting the third heat exchanger (point 17), however, is passed through heat exchanger RS in countercurrent flow to the expanded vapor from turbine T-I where the flow stream from the third heat exchanger is heated. The heated, vaporous water and oil stream from heat exchanger RS (point 18) is flowed to turbine T-II where it is expanded, giving-off energy and producing a water and oil stream (point 19) wherein both substances are present in vapor and liquid states.

A thermal balance of the cycle reveals that for the flow streams of Table I:

power absorbed from the external source was 32,169 kW;

power yielded in turbine T-I was 7,276 kW ($\eta$ isentropic=0.90)

power yielded in turbine T-II was 3,820 kW ($\eta$ isentropic=0.80);

total power yielded in the turbine was 11,096 kW; and, the cycle efficiency according to thermal balance was 34.50%.

Accounting for other losses and the power consumed in pumping, overall results of the cycle are as follows:

net electric power of the cycle (all losses and consumption in pumps discounted) was 10,100 kW; and net electrical efficiency of the cycle was 31.4%.

Figure 3:
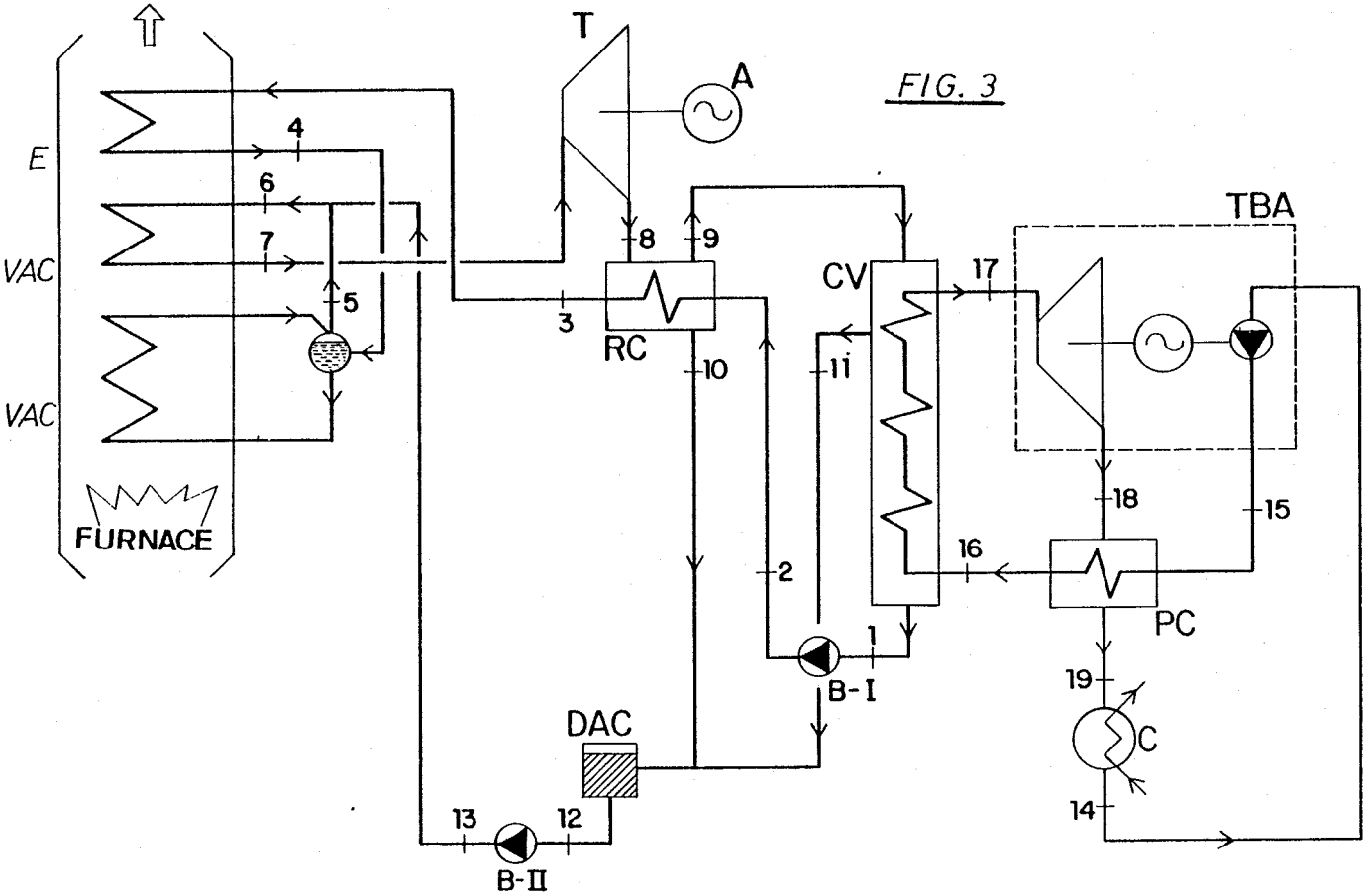
FIG. 3 illustrates another power cycle according to the invention.

Referring now to FIG. 3, another power cycle of the invention is illustrated. This cycle operates with a mixture of water and aforementioned oil, and absorbs energy from the same source as in the preceding example, cooling the gases in the same way. The energy absorbed by the cycle is used for generating electric power in a turbine and residual heat is sent to a secondary cycle R-113. This secondary cycle in turn generates electric power through a group of turbo-pump-alternators which can be completely sealed in order to prevent fluid leak, the Residual heat is sent to the heat sink which is cooling water at 15° C.

Figure 4:
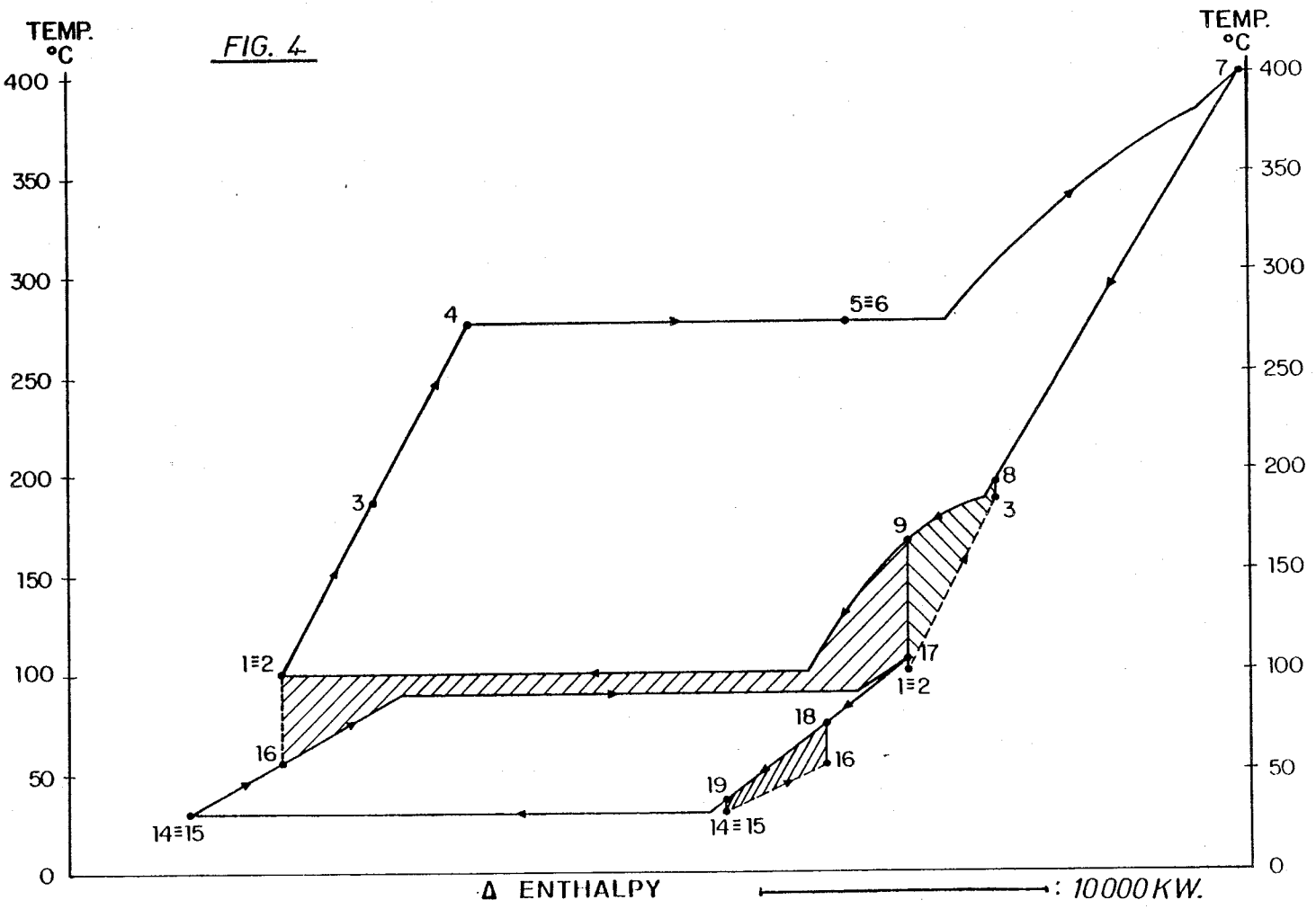
FIG. 4 illustrates a plot of t- H for the power cycle of FIG. 3.

FIG. 3 shows the main diagram of the two cycles. The abbreviations used in the figure are:

E=Economizer
VAC=Oil vaporizer
VAG=Water vaporizer
T=Turbine
B=Pump
A=Alternator
RC=Recuperator-heater
DAC=Oil tank
CV=Condenser-vaporizer
TBA=Turbo-pump-alternator
PC=Condensate preheater
C=Condenser FIG. 4 below is a t-ΔH diagram of the system, illustrating the thermal level and the relative magnitudes of the enthalpy yields and absorptions of the heat exchanges and in-turbine expansions.

Table 2 below shows, for each point of the cycle, the circulating flow of each substance and its phase, as well as the pressure, temperature and enthalpic flow. This thermal balance does not take into account pressure drop, fluid leak, thermal loss or the heat yielded to the fluid by the pumps, but does consider the isentropic efficiencies in the turbines and the practical minimum temperature differences in heat exchangers. The enthalpic values have been calculated by algorithms.

TABLE 2

PRIMARY CYCLE

| CYCLE POINT | WATER FLOW (kg/s) PHASE (L/V) | OIL FLOW (kg/s) PHASE (L/V) | ENTHALPIC FLOW (kW) | PRESSURE (bar abs) | TEMPERATURE (°C.) |
|---|---|---|---|---|---|
| 1 | 8.33/L | 0.67/L | 2764 | 1 | 100 |
| 2 | 8.33/L | 0.67/L | 2764 | 60 | 100 |
| 3 | 8.33/L | 0.67/L | 5896 | 60 | 185 |
| 4 | 8.33/L | 0.67/L | 9041 | 60 | 275 |
| 5 | 8.33/V | 0.67/L | 22386 | 60 | 276 |
| 6 | 8.33/L & V | 12.5/L & V | 25248 | 60 | 275 |
| 7 | 8.33/V | 12.5/V | 38691 | 60 | 400 |
| 8 | 8.33/V | 12.5/V | 30651 | 1 | 193 |
| 9 | 8.33/V | 5.92/V | 25735 | 1 | 162 |
| 10 | 0 | 6.58/L | 1784 | 1 | 175 |
| 11 | 0 | 5.25/L | 1078 | 1 | 145 |
| 12 | 0 | 11.83/L | 2862 | 1 | 162 |
| 13 | 0 | 11.83/L | 2862 | 60 | 162 |

SECONDARY CYCLE

| CYCLE POINT | R - 113 FLOW (kg/s) PHASE (L/V) | ENTHALPIC FLOW (kW) | PRESSURE (bar abs) | TEMPERATURE (°C.) |
|---|---|---|---|---|
| 14 | 121/L | 53751 | 0.5 | 28 |
| 15 | 121/L | 53751 | 3.5 | 28 |
| 16 | 121/L | 56689 | 3.5 | 54 |

TABLE 2-continued

| | | | | |
|---|---|---|---|---|
| 17 | 121/V | 78582 | 3.5 | 110 |
| 18 | 121/V | 75471 | 0.5 | 74 |
| 19 | 121/V | 72533 | 0.5 | 35 |

Enthalpy reference points:
Water: 0 kJ/kg liquid at 25° C.
Oil: 0 kJ/kg liquid at 25° C.
R - 113: 419 kJ/kg liquid at 0° C.

Referring to FIG. 3, at point 1, a liquid flow is recovered form condenser/vaporizer CV which is mostly water and a small amount of oil. This stream is pumped via pump B-I to recuperator/heater heat exchanger RC (point 2) where it runs countercurrent to a fluid stream exiting turbine T, which will be discussed below. The liquid flow from condense/vaporizer CV is heated in heat exchanger RC.

The heated liquid flow exiting heat exchanger RC (point 3) is heated further in a furnace (point 4). Heated liquid flow is then collected in a tank and returned to the furnace where it is vaporized (point 5). The vaporized water and oil flow is mixed with additional oil to produce a flow stream of water and oil with both substances in both liquid and vapor phases (point 6). The flow stream is then returned to the furnace where the liquid phase of the stream is vaporized to produce a vaporous stream (point 7).

The vaporous stream is then expanded in turbine T to produce an expanded vapor mixture of water and oil (point 8). The expanded vapor mixture is cooled in heat exchanger RC by countercurrent flow with the flow stream from the condenser/vaporizer CV. Oil condensing in heat exchanger RC is removed from the heat exchanger (point 10) and collected in an oil tank, which will be discussed in more detail below.

Cooled vaporous water and oil exits heat exchange RC (point 9) and enters condenser/vaporizer CV. Oil condenses in condenser/vaporizer CV and flows (point 11) to oil tank DAC where it is collected. Liquid oil in oil tank DAC flows (point 12) to pump B-II where it is pumped (point 13) to the furnace. Prior to introduction of the oil to the furnace, it is mixed with the vaporized water to produce the water and oil flowstream, as discussed above wherein both the heater and oil are present in liquid and vapor phases.

The power cycle of this embodiment also utilizes a secondary cycle show on the right side of FIG. 3. In the secondary cycle, vapor working fluid (point 19), such as R-113, is condensed to a liquid (point 14) in condenser C. The liquid fluid is then pumped to a higher pressure (point 15) and it enters condensate preheater PC where it is heated. Heated condensate exits condensate preheater PC (point 16) and enters condenser/vaporizer CV of the main power cycle, where the secondary cycle fluid lows countercurrent to the working fluid exiting the recuperator/heater RC, and is heated thereby to produce a vapor of the secondary cycle fluid (point 17).

The vapor at point 17 is expanded in a turbine powered by an alternating current power source (which also powers the secondary cycle pump) to produce an expanded vaporous working fluid (point 18). The expanded working fluid is cooled in condensate preheater PC by countercurrent flow with the working fluid condensate from condenser C.

A global thermal balance reveals the following:

power absorbed from the external source was 29,933 kW;

power yielded in the primary cycle turbine was 8,040 kW ($\eta$ iso - 0.90);

power transferred from the primary to the secondary cycle was 21,893 kW;

power yielded in the secondary cycle turbine was 3,111 kW ($\eta$ iso - 0.85);

total power yielded in turbines was 11,151 kW; and the cycle efficiency according to thermal balance was 37.3%.

Accounting for the remainder of the losses previously mentioned and the power consumed in pumping, the overall results calculated for the whole system are the following:

net electric power of the system (all losses and consumption in pumps discounted) was 10,130 kW;

net electrical efficiency of the system was 33.8%

Although the present invention has been described in connection with a preferred embodiment thereof, many other variations and modifications will now become apparent to those skilled in the art.

What is claimed is:

1. A power cycle which utilizes a working fluid comprising a mixture of water and a second substance, the second substance having a lower volatility, a molecular weight greater than water and the ability to superheat in isentropic expansion, comprising:

(a) vaporizing the working fluid at maximum cycle pressure and variable temperature with heat from an external energy source;

(b) expanding the working fluid at least once from the maximum cycle pressure to a lower pressure;

(c) cooling the expanded working fluid at variable temperature and constant pressure less than the maximum cycle pressure to condense at least part of the second fluid as a first condensate and produce heat;

(d) condensing the expanded working fluid to produce a second condensate;

(e) pumping the first and second condensate up to the maximum cycle pressure;

(f) heating the first and second condensate with the heat from step c; and, (g) recycling the first and second condensate to step a.

2. A power cycle as claimed in claim 1, wherein the second substance comprises a mixture of substances having substantially similar saturation curves, the mixture substantially behaving as a single fluid.

3. A power cycle as claimed in claim 1, wherein the expanding of the working fluid comprises a first occuring between the expansion, the cooling of the working fluid occuring between the first and second expansion, and the condensing of the expanded working fluid is performed at a minimum cycle pressure.

4. A power cycle as claimed in claim 1, wherein the first and second condensate are pumped at an intermediate pressure prior to the pumping of the first and second condensate up to the maximum cycle pressure.

5. A power cycle as claimed in claim 1, further comprising heating the first and second condensate with heat from an external source.

6. A power cycle as claimed in claim 1, further comprising removing the heat from the power cycle.

7. A power cycle employing a working fluid comprising a liquid which is a majority of water and a minority of a second substance, comprising:

(a) heating the working fluid at maximum cycle pressure with energy from an external heat source;

(b) vaporizing the heated working fluid to a vapor phase, the vaporization starting at a eutectic temperature of the working fluid and continuing at variable temperature during non-eutectic vaporization of the working fluid;

(c) mixing the vapor phase with additional liquid second substance to form a two-phase mixture of the working fluid vapor phase and additional second substance liquid phase;

(d) vaporizing the two-phase mixture with heat from the external energy source to form a vaporized mixture, the vaporization of the mixture being at a variable temperature for non-eutectic vaporization of the second fluid;

(e) expanding the vaporized mixture from the maximum cycle pressure to a minimum cycle pressure;

(f) cooling the vaporized mixture until substantially all the second substance condenses and forms a first condensate, the cooling producing heat and resulting in a vapor phase containing a majority of water;

(g) condensing remaining vapor in the mixture at the minimum cycle pressure to form a second condensate and release heat;

(h) compressing the second condensate from the minimum cycle pressure to the maximum cycle pressure and recycling the second condensate to step a; and (i) compressing the first condensate from the minimum cycle pressure to the maximum cycle pressure and recycling the first condensate to step c.

8. A power cycle as claimed in claim 7, further comprising superheating the vaporized mixture prior to expanding the vaporized mixture.

9. A power cycle as claimed in claim 7, further comprising mixing additional liquid second substance with the working fluid prior to vaporizing step b.

10. A power cycle as claimed in claim 7, further comprising heating the first condensate with a portion of the heat produced in step g and heat from the external energy source prior to recycling the first condensate to step c.

11. A power cycle as claimed in claim 7, wherein the compressing the first condensate and the second condensate comprises a plurality of compression stages with intermediate heating.

12. A power cycle as claimed in claim 7, further comprising extracting vapor during expanding of the vaporized mixture.

13. A power cycle as claimed in claim 7, wherein the expanding of the vaporized mixture comprises at least two expansions of the vaporized mixture, cooling the vaporized mixture, condensing a portion of the second substance at variable temperature, and separating second substance condensate between expansions.

14. A power cycle as claimed in claim 7, wherein the heat produced by cooling the vaporized mixture is removed from the power cycle.

15. A power cycle as claimed in claim 7, further comprising heating the second condensate with a portion of the heat produced in step g prior to recycling the second condensate to step a.

16. A power cycle as claimed in claim 7, further comprising heating the second condensate with the remainder of the heat produced in step g prior to recycling the second condensate to step a.

17. A power cycle as claimed in 7, further comprising heating the first condensate prior to recycling to step c and heating the second condensate prior to recycling to step a, the heating of the first condensate and the second condensate being from an external energy source.

18. A process as claimed in claim 7, wherein the heat produced in steps f and g is used to heat combustion air.

19. A process as claimed in claim 7, wherein the heat produced in steps f and g is used to generate mechanical power.

20. A process as claimed in claim 7, wherein expanding the vaporized mixture comprises a plurality of expansions of the vaporized mixture, each expansion producing heat.

21. A process as claimed in claim 20, further comprising preheating the working fluid with heat given off in at least one of the plurality of expansions.

22. A power cycle as claimed in claim 21, further comprising superheating the working fluid between the plurality of expansions.

* * * * *